US006629634B2

(12) United States Patent
Simmons

(10) Patent No.: US 6,629,634 B2
(45) Date of Patent: Oct. 7, 2003

(54) WINDOW MAILBOX

(76) Inventor: Brenda Ann Simmons, 313 Kingsbury St., Oxford, NC (US) 27565

( * ) Notice: Subject to any disclaimer, the term of this patent is extended or adjusted under 35 U.S.C. 154(b) by 0 days.

(21) Appl. No.: 09/799,426

(22) Filed: Mar. 5, 2001

(65) Prior Publication Data

US 2002/0121543 A1 Sep. 5, 2002

Related U.S. Application Data

(60) Provisional application No. 60/186,702, filed on Mar. 3, 2000, and provisional application No. 60/268,071, filed on Feb. 12, 2001.

(51) Int. Cl.[7] ..... B65G 11/04

(52) U.S. Cl. ..... 232/45; 232/34; 232/43.1; 220/345.4; 220/662; 340/569

(58) Field of Search ..... 232/17, 45, 43.1, 232/38, 34; 220/345.1, 345.4, 377, 602, 662, 663

(56) References Cited

U.S. PATENT DOCUMENTS 592,903 A * 11/1897 Bruseau ..... 232/45
2,370,682 A * 3/1945 Overmeyer ..... 232/45
2,983,437 A * 5/1961 Vandruff ..... 232/17
3,680,773 A * 8/1972 Thompson ..... 232/17
4,650,113 A * 3/1987 Hunt ..... 232/17
4,982,141 A * 1/1991 Pace et al. ..... 315/169.3
5,056,711 A * 10/1991 Bush ..... 232/17
5,096,115 A * 3/1992 Hassan ..... 232/17
5,346,125 A * 9/1994 Critzer, Sr. ..... 232/17
5,695,113 A * 12/1997 Rau et al. ..... 232/34
5,950,919 A * 9/1999 Adams ..... 232/34
5,954,264 A * 9/1999 Keller ..... 232/17
5,979,751 A * 11/1999 Maddox ..... 232/52
6,028,517 A * 2/2000 Sansone et al. ..... 340/569
6,102,548 A * 8/2000 Mantle et al. ..... 362/155
6,302,325 B1 * 10/2001 Alexander ..... 232/43.1

* cited by examiner

*Primary Examiner*—William L. Miller
(74) *Attorney, Agent, or Firm*—McKenna, Long & Aldridge LLP

(57) ABSTRACT

A rural type mailbox having transparent windows formed through the front and rear thereof, a slidable transparent window, which allows the user to open the window to access the interior from the side of the mailbox to remove or enter mail when desired. The mailbox further includes a mail-in-box indicator LED to let the user know when mail has arrived, the LEDs illuminate inside the mailbox to enabling a user to see inside the mailbox at night using a remote control. The mailbox includes a solar panel for housing rechargeable batteries.

18 Claims, 5 Drawing Sheets

WINDOW MAILBOX

BACKGROUND OF THE INVENTION

This application claims the benefit of provisional Application Nos. 60/186,702 filed on Mar. 3, 2000, and 60/268,071 filed Feb. 12, 2001, which are hereby incorporated by reference for all purposes as if fully set forth herein.

FIELD OF THE INVENTION

The present invention relates to rural type mailboxes and more particularly to a rural mailbox having transparent windows and doors formed on the front, sides and rear of mailbox allowing the user to view inside the mailbox with a glance without opening the mailbox thereof to check for mail.

DISCUSSION OF THE RELATED ART

It is often difficult for individuals to determine whether mail has been delivered to the mailbox and in particular rural type mailboxes, which is often positioned at the street or across the street. The user must often walk to the street or across the street and open the mailbox door and stand in front of mailbox exposing the user to dangerous traffic conditions to determine whether mail has been delivered. It would be desirable, therefore, to have a rural mailbox having a transparent windows and doors formed on the front, rear, and sides thereof so that a user could view through the windows and doors to determine whether mail has been placed inside the mailbox. A remote control that operates a light inside the mailbox would allow the user to view inside the mailbox at night. In addition, it would be desirable if the transparent window or doors were capable of sliding open to allow access to the interior of mailbox so that mail could be removed by a user safely through the windows or doors.

SUMMARY OF THE INVENTION

It is thus an object of the invention to provide a window mailbox for rural type mailboxes that includes transparent windows and doors that are capable of sliding; and a remote control that operates a light inside the mailbox that allows a user to view the interior of the mailbox to determine whether mail has been deposited or removed from the mailbox. When walking up to the mailbox, a transparent slidable window or door would provide a means of checking and retrieving mail without exposing the user to dangerous traffic conditions. The window or door would allow the user to approach the mailbox by driving up in a vehicle and retrieving or depositing mail.

Accordingly, a window mailbox is provided. The rural mailbox includes transparent windows or doors formed on the front, rear and sides thereof and can include a slide assembly to allow the window or door to slide and operate as an access door for retrieving or depositing mail when desired. A remote control transmitter could remotely illuminate the inside of the mailbox to view any mail through the windows or doors provided.

BRIEF DESCRIPTION OF THE DRAWINGS

For a further understanding of the nature and objects of the present invention, reference to the following detailed description, taken in conjunction with the accompanying drawings, in which like elements are given the same or analogous reference numbers.

In the drawings.

DETAILED DESCRIPTION OF THE ILLUSTRATED EMBODIMENTS

Reference will now be made in detail to the illustrated embodiments of the present invention, examples of which are illustrated in the accompanying drawings.

Figure 1:
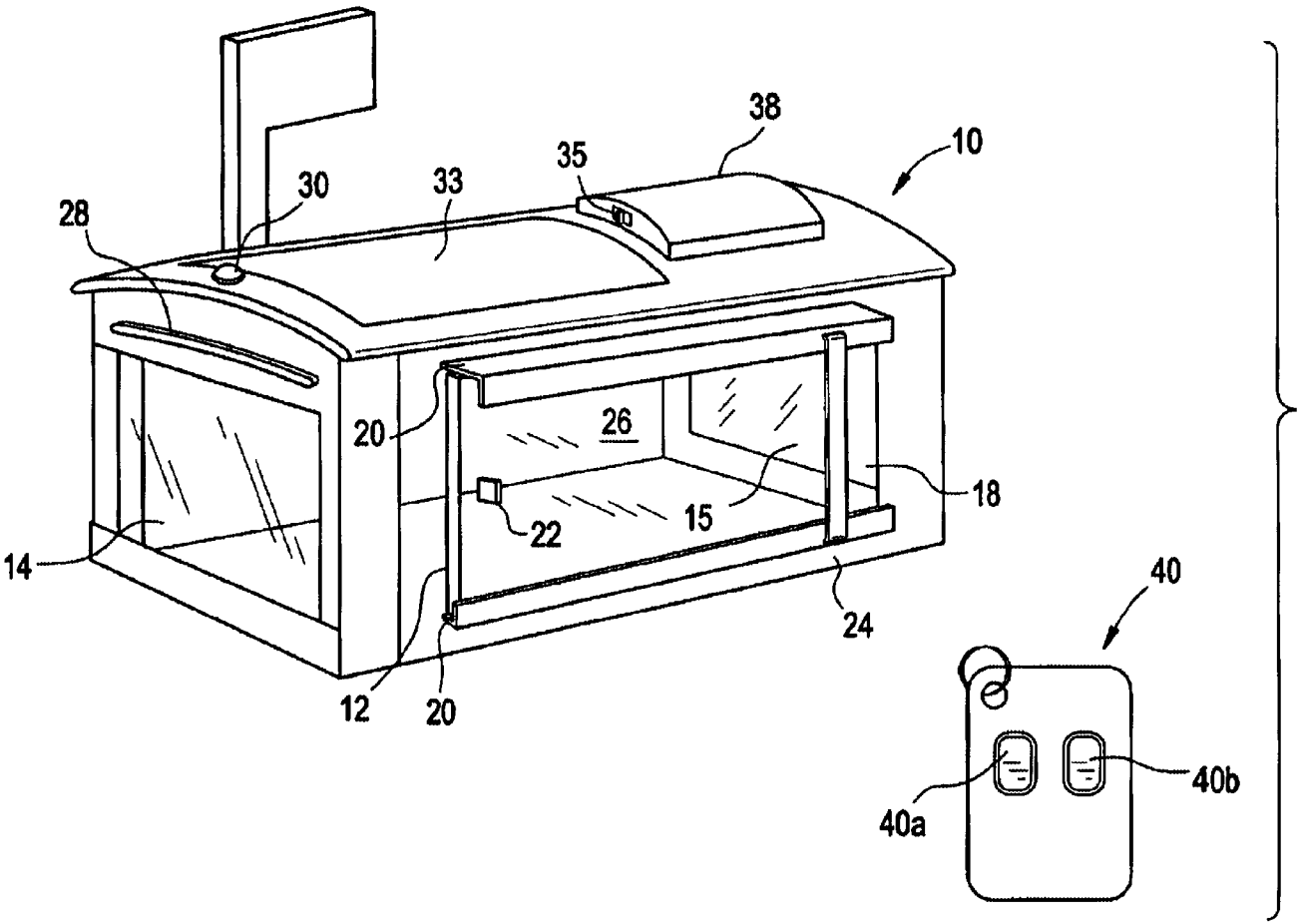
FIG. 1 shows a window mailbox and portable remote control transmitter of the present invention.

FIG. 1 shows a window mailbox and portable remote control transmitter of the present invention.

The window mailbox 10 comprises a housing 12 having a bottom portion and a top portion and having suitable size for receiving mailed letters or packages. The housing 12 has a front door 14, a rear door 15, a first side window 26, and a mail-in-box indicator LED 30 for alerting the user to the presence of mail. The housing 12 is a flat panel, which is substantially two-dimensional. Preferably, housing 12 further comprises a second side window having a panel 18 including a slide bars 20*a* and 20*b*, which slidably engage a stop bar 24 to prevent further travel of the panel 18 along the slide bars. Preferably, panel 18 comprises an indentation or area of friction (or roughness) on a thumb slide 22 to aid in initiating and/or facilitating the back and forth movement of panel 18 along the slide bars 20*a* and 20*b* for opening and closing access to the mailbox housing 12. Preferably, panel 18 is made of or comprises a transparent material (e.g., shatterproof glass, plexiglass, and the like) such that the inside of housing 12 is viewable from the outside through panel 18. Preferably, indicator 30 is a battery powered LED indicator. Where indicator 30 is a battery powered LED (light emitting diode) indicator, the battery housing 38 is preferably includes a rechargeable battery, and more preferably the battery is a solar rechargeable battery. Where the battery is a solar rechargeable battery, housing 12 further has a solar panel 33, electrically connected to the battery used to power the LED, for recharging the battery. Housing 10 further comprises control mechanism (or on/off toggle switch) 35 located on housing 10 for manually lighting the inside of the housing 12. Control buttons 40*a* and 40*b* located on a portable transmitter remote 41 also function to control lighting inside of housing 12. Optionally, but preferably, the mailbox 10 further comprises a front window 14 in the form of a door movably connected to the housing by a handle 28 at one of its four sides for providing an additional point of access to the inside of the housing 12.

Figure 2:
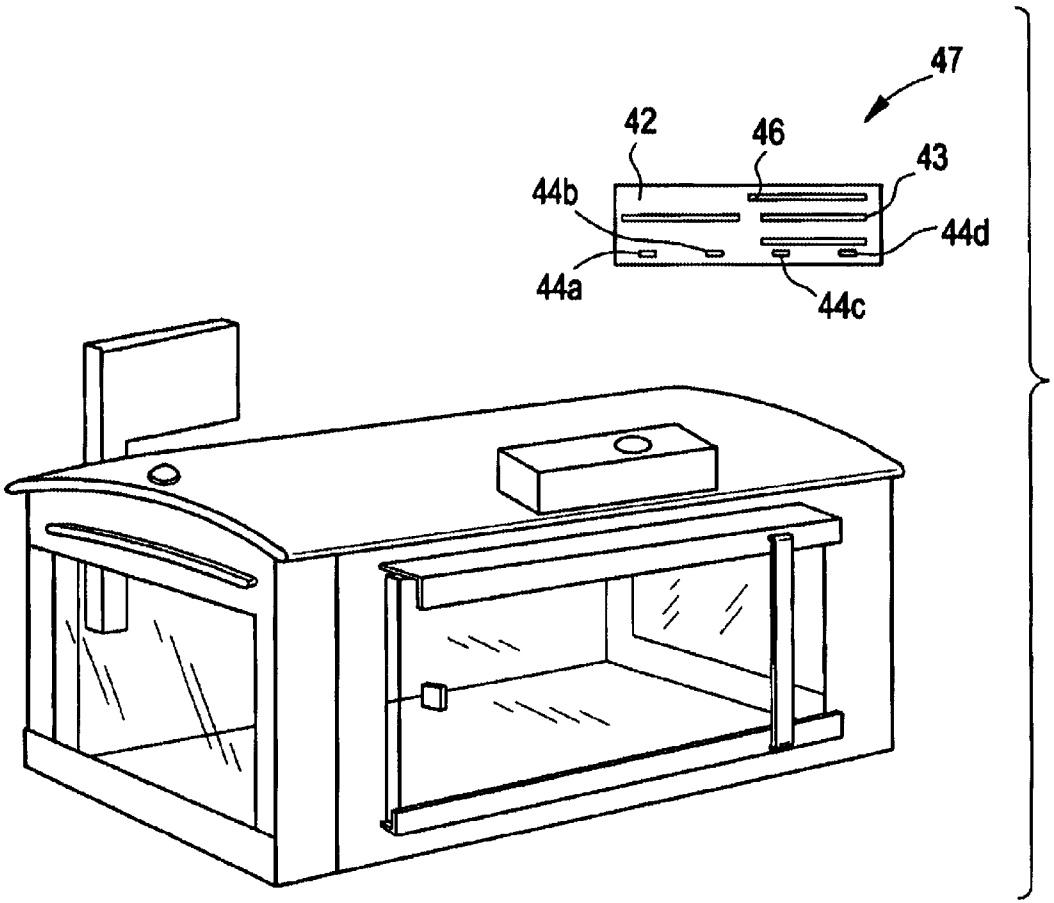
FIG. 2 shows a remote RF receiver circuit board which controls jumbo LED lights for lighting the inside of the mailbox housing.

FIG. 2 shows a remote RF receiver unit.

The portable transmitter remote 41 works in partnership with the RF receiver unit 47, which is mounted inside the housing 12 of the window mailbox 10. LEDs 44*a*–44*d* illuminate inside of the mailbox 10 when the remote 41 is triggered. Solar panel recharging circuit 46, digital voltage receiving device 42, driver circuit 43, and electronic senor 48, latch to drive jumbo light emitting diodes 44*a*–44*d*. The control mechanism 35 of portable transmitter remote 41 of FIG. 1 work in partnership with the RF receiver unit 47, which is mounted inside the housing 12 of the window mailbox 10. The rechargeable batteries that power the LED indicator 30 preferably power jumbo LED lights 44*a*–44*d*.

Figure 3:
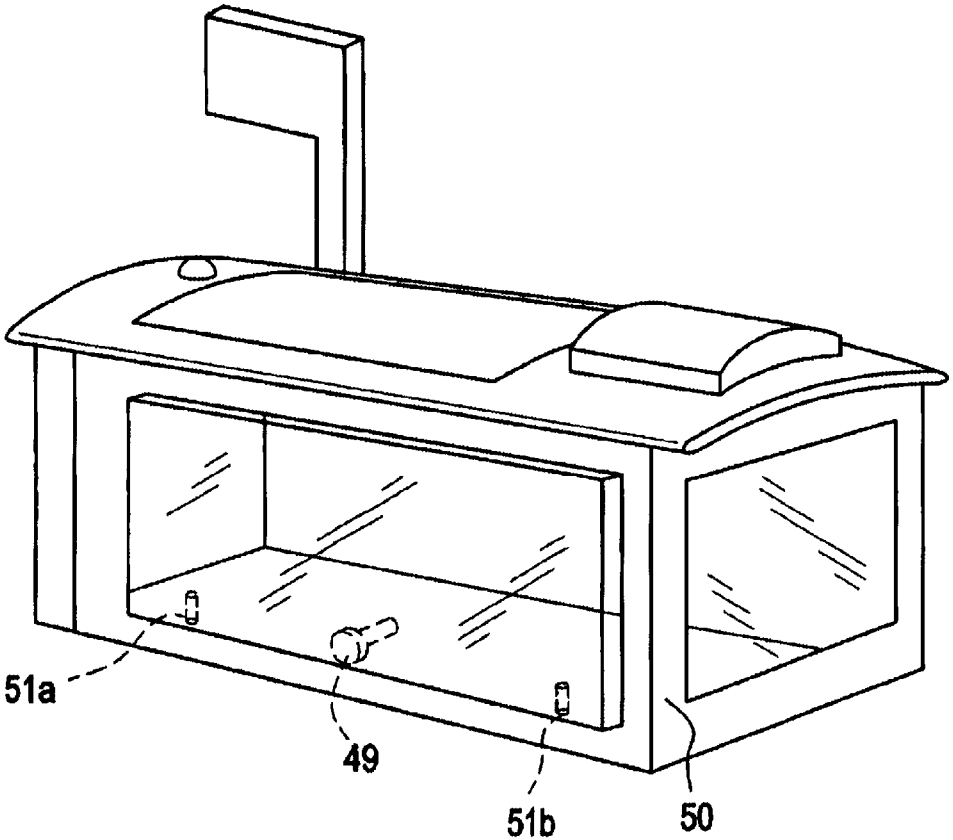
FIG. 3 shows a sensor mechanism used to trigger the LED indicator on the mailbox.

FIG. 3 shows a sensor mechanism used to trigger the LED indicator on the mailbox.

The piezoelectric sensor 49 detects mail placed on light-weight sensor platform 50, which is used to trigger internal sensors on opposite sides of the mailbox. The sensor mechanism preferably comprises a flexible light-weight sensor platform 50 which is placed on strips of piezoelectric film 49 which are positioned at the inside bottom portion of housing 12 such that applying small amounts of force to platform 50 bends piezoelectric film 49. The material used to form that of the lightweight platform can include metal, but is not limited to metal.

Alternatively, the flexible lightweight material platform 50 can be placed on low compression springs 51*a* and 51*b* and positioned near the inside bottom portion of housing 12. The springs 51*a* and 51*b* are positioned at the corners or at equidistant points along the perimeter of the platform 50. Strips of piezoelectric film 49 are positioned between the platform 50 and the bottom portion of housing 12 such that upon applying a force to platform 50 sufficient to compress springs 51*a* and 51*b*, platform 50 bends piezoelectric film 49.

When mail (letters or packages) is placed in housing 12, the weight of the mail applies a force to platform 50 and bends piezoelectric strip 49, which causes a piezoelectric affect in the form of a low current spike voltage. This voltage triggers a digital voltage receiving device 42 such as a one-shot monostable multivibrator. The digital voltage receiving device 42 provides a pulse to trigger the driver circuitry to light the LED indicator 30 on the RF receiver unit 47 as shown in the R.F. receiver circuit board in FIG. 5.

Figure 4:
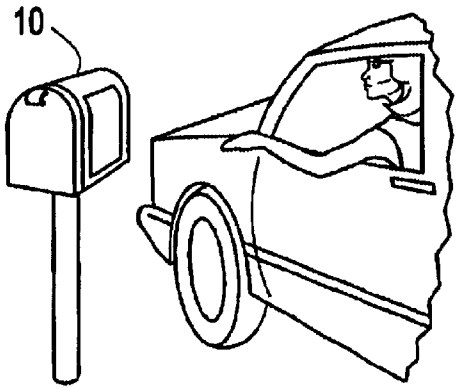
FIG. 4 shows mailbox 10 being approached by a representative user.

FIG. 4 shows mailbox 10 being approached by a representative user.

Figure 5:
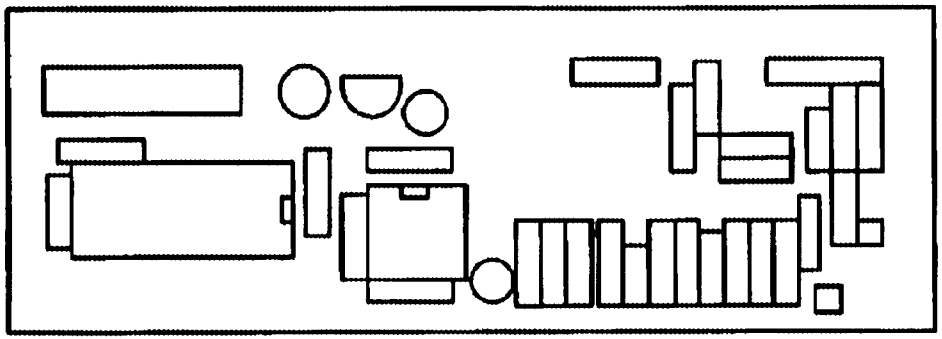
FIG. 5 shows R.F. receiver circuit board.

FIG. 5 shows R.F. receiver circuit board.

Figure 6B:
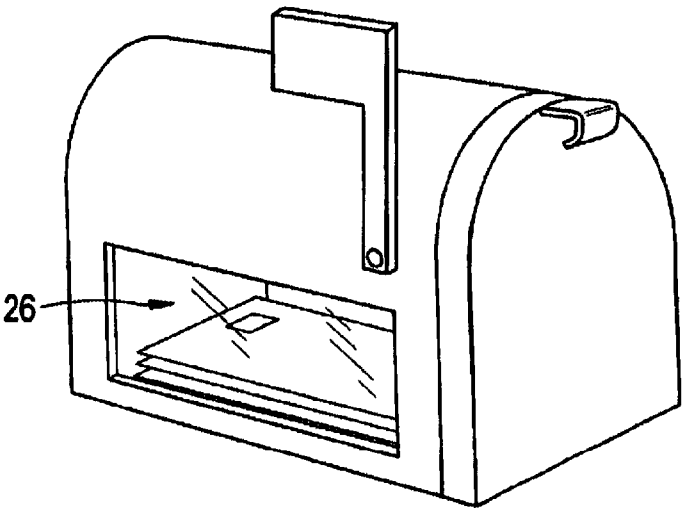
FIGS. 6A and 6B show a window mailbox according to another aspect of the present invention.
Figure 6A:
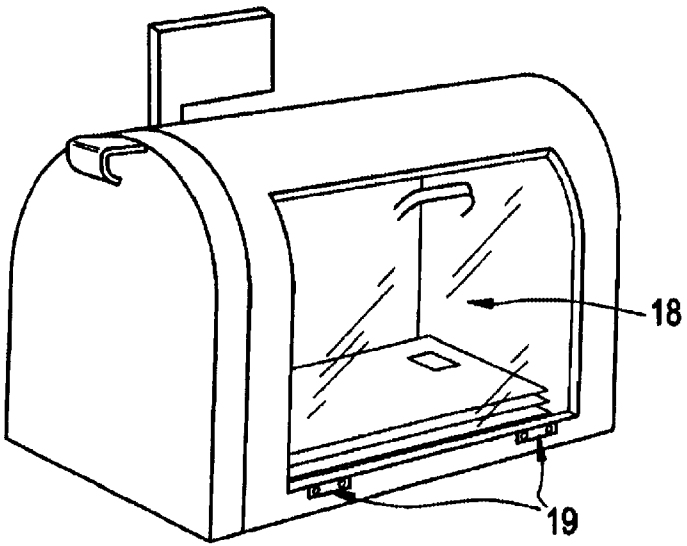

FIGS. 6A and 6B show a window mailbox according to another aspect of the present invention. In FIG. 6A, opaque housing 12 comprises a second side window having a transparent panel 18 including hinges 19 to permit opening and closing the panel. However, rather than hinges 19, the panel 18 can also be slidable as in FIG. 1. In FIG. 6B, opaque housing 12 comprises a first side window 26 that is transparent.

It can be seen from the preceding description that a window mailbox has been provided.

In a preferred embodiment, a slidable or hinged door or window is provided which allows the user to access the interior of the mailbox to deposit or remove mail when desired. The mailbox has a thin lightweight sensor platform that triggers a piezoelectric sensor on the inside of the mailbox under the platform. The piezoelectric sensor signal is routed through an amplifier and buffer to provide sufficient signal strength and signal forming characteristics to the signal to convert it to digital levels (i.e., 5V—square wave).

Once the signal is transmitted from the sensor in the mailbox, it will cause a single bright light emitting diode on the top front of the mailbox to be illuminated, letting users know that mail has arrived. An internal light is turned on and off by a remote control transmitter.

An owner of the mailbox may use a remote control transmitter (similar to a car alarm remote control) to remotely illuminate the inside of the mailbox using a first button to view mail through the windows or doors at night. 6-AA rechargeable batteries may power and reside in the battery housing on the top of the mailbox to provide internal illumination. Charging of the 6—AA rechargeable batteries is provided by a flexible solar panel and charging circuit, which charges the batteries to optimum voltage levels. The charging circuit may be turned off near the battery housing by an on/off switch or remotely by a second button on the remote control transmitter. Internal mailbox illumination is provided by 4 jumbo light emitting diodes (LEDs) mounted in the inside roof of the mailbox. A power driver circuit designed to provide sufficient voltage drives these diodes and current from the rechargeable batteries to illuminate the inside of the mailbox so the user may view the mail that has arrived. The jumbo LEDs are turned on or off by the remote control transmitter at the will of the user. This is done to view the inside of the mailbox.

The remote control transmitter works in partnership with the RF receiver unit, which is mounted inside the mailbox. The receiver and transmitter are a standard receiver/transmitter pair, which is U.L. approved.

The purpose of the receiver unit is:

1) to receive and react to the signal from a first button of the transmitter to turn on and off the internal jumbo LEDs to view mail; and 2) to receive and react to the signal from a second button of the transmitter to turn on or off the battery charging circuit in the mailbox.

It is noted that the embodiment of the window mailbox described herein in detail for exemplary purposes is of course subject to many different variations in structure, design, application and methodology. Because many modifications may be made in the embodiment herein detailed in accordance with the descriptive requirements, it is to be understood that the details herein are to be interpreted as illustrative and not in a limiting sense.

What is claimed is:

1. A mailbox, comprising:

a housing having at least three side portions, a bottom portion, a top portion, an outside portion, and an inside portion, wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing, provided that at least a portion of another one of the at least three side portions not having a panel connected thereto comprises a transparent material for permitting viewing of the inside portion of the housing through the another side portion; a door movably connected to said housing; and an indicator flag connected to said housing for signaling the presence of mail.

2. A mailbox, comprising:

a housing having at least three side portions, a bottom portion, a top portion, an outside portion, and an inside portion, wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing, provided that at least a portion of another one of the at least three side portions not having a panel connected thereto comprises a transparent material for permitting viewing of the inside portion of the housing through the another side portion; a door movably connected to said housing; and a light emitting indicator and indicator flag mounted to the outside portion of the housing for signaling the presence of mail.

3. A mailbox, comprising:

a housing having at least three side portions, a bottom portion, a top portion, an outside portion, and an inside portion, wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing, provided that at least a portion of another one of the at least three side portions not having a panel connected thereto comprises a transparent material for permitting viewing of the inside portion of the housing through the another side portion; a door movably connected to said housing;

a light emitting indicator and indicator flag mounted to the outside portion of the housing for signaling the presence of mail;

a driver circuit electrically connected to the light emitting indicator;

at least one strip of a piezoelectric film;

a digital voltage receiving device electrically connected to the piezoelectric film and the driver circuit; and a platform located on the piezoelectric film on the bottom portion and inside portion of the housing such that applying a force to the platform bends the piezoelectric film which sends a low current spike voltage to the digital voltage receiving device which provides a pulse to trigger the driver circuit for illuminating the light emitting indicator.

4. A mailbox according to claim 3, wherein the digital voltage receiving device is a monostable multivibrator.

5. A mailbox, comprising:

a housing having at least three side portions, a bottom portion, a top portion, an outside portion, and an inside portion, wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing, provided that at least a portion of another one of the at least three side portions not having a panel connected thereto comprises a transparent material for permitting viewing of the inside portion of the housing through the another one of the at least three side portions; a door movably connected to said housing; an indicator flag connected to said housing for signaling the presence of mail; and a light source mounted at the inside portion of the housing for providing sufficient lighting to the inside portion of the housing to permit viewing of the inside portion of the housing, wherein the light source can be activated from one of a control unit located on the inside portion of the housing and from a control unit remote from the housing.

6. A mailbox, comprising:

a housing having at least three side portions, a bottom portion, a top portion, an outside portion and an inside portion, wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing, provided that at least a portion of another one of the at least three side portions not having a panel connected thereto comprises a transparent material for permitting viewing of the inside portion of the housing through the another side portion;

a light source mounted at the inside portion of the housing for providing sufficient lighting to the inside portion of the housing to permit viewing of the inside portion of the housing, wherein the light source can be activated from one of a control unit located on the inside portion of the housing and from a control unit remote from the housing; a door movably connected to said housing; and a light emitting indicator and indicator flag mounted on the outside portion of the housing for signaling the presence of mail.

7. A mailbox, comprising:

a housing having at least three side portions, a bottom portion, a top portion, an outside portion, and an inside portion, wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing, provided that at least a portion of another one of the at least three side portions not having a panel connected thereto comprises a transparent material for permitting viewing of the inside portion of the housing through the another side portion a door movably connected to said housing;

a light source mounted at the inside portion of the housing for providing sufficient lighting to the inside portion of the housing to permit viewing of the inside portion of the housing, wherein the light source can be activated from one of a control unit located at the inside portion of the housing and from a control unit remote from the housing, and wherein the light source is battery powered by a rechargeable battery;

a light emitting indicator and indicator flag mounted on the outside portion of the housing for signaling the presence of mail; and a solar energy source on the outside portion of the housing for recharging the battery.

8. A mailbox, comprising:

a housing, comprising:

a top portion and a bottom portion;

an inside portion and an outside portion;

a front portion having a door movably connected to the outside portion of the housing, wherein at least a portion of said door comprises a transparent material for viewing the inside portion of the housing; and at least three side portions wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing;

a light source mounted at the inside portion of the housing for providing sufficient lighting to the inside portion of the housing to permit viewing of the inside portion of the housing, wherein the light source can be activated from one of a control unit located on the inside portion of the housing and from a control unit remote from the housing; and a light emitting indicator and indicator flag mounted on the outside portion of the housing for signaling the presence of mail.

9. A mailbox according to claim 8, wherein the transparent material is one of shatterproof glass and plexiglass.

10. A mailbox, comprising:

a housing having at least three side portions, a bottom portion, a top portion, an outside portion, and an inside portion, wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing, provided that at least a portion of another one of the at least three side portions not having a panel connected thereto comprises an opaque material for preventing viewing of the inside portion of the housing through the another side portion; a door movably connected to said housing; and an indicator flag connected to said housing for signaling the presence of mail.

11. A mailbox, comprising:

a housing having at least three side portions, a bottom portion, a top portion, an outside portion, and an inside portion, wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing, provided that at least a portion of another one of the at least three side portions not having a panel connected thereto comprises an opaque material for preventing viewing of the inside portion of the housing through the another side portion; a door movably connected to said housing; and a light emitting indicator and indicator flag mounted to the outside portion of the housing for signaling the presence of mail.

12. A mailbox, comprising:

a housing having at least three side portions, a bottom portion, a top portion, an outside portion, and an inside portion, wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing, provided that at least a portion of another one of the at least three side portions not having a panel connected thereto comprises an opaque material for preventing viewing of the inside portion of the housing through the another side portion; a door movably connected to said housing;

a light emitting indicator and indicator flag mounted to the outside portion of the housing for signaling the presence of mail;

a driver circuit electrically connected to the light emitting indicator;

at least one strip of a piezoelectric film;

a digital voltage receiving device electrically connected to the piezoelectric film and the driver circuit; and a platform located on the piezoelectric film on the bottom portion and inside portion of the housing such that applying a force to the platform bends the piezoelectric film which sends a low current spike voltage to the digital voltage receiving device which provides a pulse to trigger the driver circuit for illuminating the light emitting indicator.

13. A mailbox according to claim 12, wherein the digital voltage receiving device is a monostable multivibrator.

14. A mailbox, comprising:

a housing having at least three side portions, a bottom portion, a top portion, an outside portion, and an inside portion, wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing, provided that at least a portion of another one of the at least three side portions not having a panel connected thereto comprises an opaque material for preventing viewing of the inside portion of the housing through the another one of the at least three side portions; a door movably connected to said housing; an indicator flag connected to said housing for signaling the presence of mail; and a light source mounted at the inside portion of the housing for providing sufficient lighting to the inside portion of the housing to permit viewing of the inside portion of the housing, wherein the light source can be activated from one of a control unit located on the inside portion of the housing and from a control unit remote from the housing.

15. A mailbox, comprising:

a housing having at least three side portions, a bottom portion, a top portion, an outside portion and an inside portion, wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing, provided that at least a portion of another one of the at least three side portions not having a panel connected thereto comprises an opaque material for preventing viewing of the inside portion of the housing through the another side portion; a door movably connected to said housing;

a light source and indicator flag mounted at the inside portion of the housing for providing sufficient lighting to the inside portion of the housing to permit viewing of the inside portion of the housing, wherein the light source can be activated from one of a control unit located on the inside portion of the housing and from a control unit remote from the housing; and a light emitting indicator and indicator flag mounted on the outside portion of the housing for signaling the presence of mail.

16. A mailbox, comprising:

a housing having at least three side portions, a bottom portion, a top portion, an outside portion, and an inside portion, wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing, provided that at least a portion of another one of the at least three side portions not having a panel connected thereto comprises an opaque material for preventing viewing of the inside portion of the housing through the another side portion; a door movably connected to said housing;

a light source an indicator flag mounted at the inside portion of the housing for providing sufficient lighting to the inside portion of the housing to permit viewing of the inside portion of the housing, wherein the light source can be activated from one of a control unit located at the inside portion of the housing and from a control unit remote from the housing, and wherein the light source is battery powered by a rechargeable battery;

a light emitting indicator and indicator flag mounted on the outside portion of the housing for signaling the presence of mail; and a solar energy source on the outside portion of the housing for recharging the battery.

17. A mailbox, comprising:

a housing, comprising:

a top portion and a bottom portion;

an inside portion and an outside portion;

a front portion having a door movably connected to the outside portion of the housing, wherein at least a portion of said door comprises an opaque material for preventing viewing of the inside portion of the housing; and at least three side portions wherein at least one of the at least three side portions comprises a panel slidably connected to the outside portion of the housing such that lateral directional movement of the panel along at least one slide bar located adjacent to the bottom portion of the housing permits the panel to open and close to provide access to the inside portion of the housing through the at least one of the at least three side portions, said slide bar including a stop bar to prevent the panel from detaching from the at least one slide bar, said panel comprising a transparent material for viewing the inside portion of the housing;

a light source mounted at the inside portion of the housing for providing sufficient lighting to the inside portion of the housing to permit viewing of the inside portion of the housing, wherein the light source can be activated from one of a control unit located on the inside portion of the housing and from a control unit remote from the housing; and a light emitting indicator and indicator flag mounted on the outside portion of the housing for signaling the presence of mail.

18. A mailbox according to claim 16, wherein the transparent material is one of shatterproof glass and plexiglass.

* * * * *